US007413469B2

(12) United States Patent
Norris et al.

(10) Patent No.: US 7,413,469 B2
(45) Date of Patent: Aug. 19, 2008

(54) ELECTRICAL CONNECTOR

(75) Inventors: Nathan John Norris, Maricopa, AZ (US); Steven Jay Millard, Mechanicsburg, PA (US); Attalee S. Taylor, Palmyra, PA (US); Troy Everette Conner, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/247,698

(22) Filed: Oct. 11, 2005

(65) Prior Publication Data

US 2007/0082542 A1 Apr. 12, 2007

(51) Int. Cl.
*H01R 12/24* (2006.01)

(52) U.S. Cl. ..... 439/495; 439/499

(58) Field of Classification Search ..... 439/492, 439/494, 495, 499

See application file for complete search history.

(56) References Cited

U.S. PATENT DOCUMENTS 5,354,214 A * 10/1994 Aso et al. ..... 439/492
5,397,247 A * 3/1995 Aoki et al. ..... 439/496
5,775,938 A * 7/1998 Noro et al. ..... 439/495
5,947,764 A * 9/1999 Pan et al. ..... 439/492
5,975,934 A * 11/1999 Ichimura ..... 439/260
6,319,052 B1 * 11/2001 Chang ..... 439/495
6,464,534 B1 * 10/2002 Schramme et al. ..... 439/492
6,517,367 B2 * 2/2003 Yamane ..... 439/260
6,955,566 B2 * 10/2005 Matsunaga et al. ..... 439/630
2004/0235324 A1 * 11/2004 Kimura et al. ..... 439/108

* cited by examiner

*Primary Examiner*—Tho D. Ta
*Assistant Examiner*—Travis Chambers

(57) ABSTRACT

An electrical connector including a housing having a mating interface and a contact interface configured to receive an end of a flexible printed circuit (FPC) having at least one row of FPC contacts, and contacts received in the housing and extending between the mating interface and the contact interface. Each of the contacts being configured to engage a corresponding one of the FPC contacts. An insert member is received within the housing. The insert member includes individual fingers moving independently with respect to one another, and the insert member is configured to be loaded into the housing to a mated position at which each of the fingers separately engage the FPC.

20 Claims, 8 Drawing Sheets

ELECTRICAL CONNECTOR

BACKGROUND OF THE INVENTION

This invention relates generally to electrical connectors, and more particularly, to electrical connectors utilizing flexible printed circuits.

Electrical connectors are commonly used to interconnect electrical circuits or components to one another. As electronic packages become progressively smaller, the size of the connectors must also become smaller and in many instances, the traditional connector designs become inadequate. In particular, there is a limit to how small various components can be made. At the same time, electronic packages are requiring the electrical connectors to operate at higher speeds.

The aforementioned concerns have led to the increasing use of a flexible printed circuit (FPC) in the electrical connector. The FPC includes a row of contacts on an exterior surface of the FPC. The FPC is received within a housing of the electrical connector such that the row of FPC contacts engages a corresponding row of contacts within the housing. The contacts within the housing then engage mating contacts of a mating connector when the electrical connector is mated with the mating connector. Typically, the FPC is retained within the housing by a clamp which rotates into an engaging position after the FPC is loaded into the housing. Alternatively, the FPC is retained within the housing by an insert which is loaded into the housing to an engaging position after the FPC is loaded into the housing.

However, the use of these types of electrical connectors have some drawbacks. The use of the clamp or insert provides for uneven and insufficient loading of the FPC contacts and the contacts of the housing. For example, because the clamp or insert is a rigid and continuous member, uneven engagement between the FPC contacts and the contacts in the housing is achieved. Additionally, for additional compliance, the contacts utilized in these types of electrical connectors are relatively long and have a long signal path, thus making the use of these types of electrical connector in high speed applications difficult.

It remains a challenge to provide a low cost electrical connector that is easily modified for multiple applications, that provides a proper engagement force to each of the contacts in the housing, and that may be produced with contacts having a short signal path.

BRIEF DESCRIPTION OF THE INVENTION

In one aspect, an electrical connector is provided including a housing having a mating interface and a contact interface configured to receive an end of a flexible printed circuit (FPC) having at least one row of FPC contacts, and contacts received in the housing and extending between the mating interface and the contact interface. Each of the contacts being configured to engage a corresponding one of the FPC contacts. An insert member is received within the housing. The insert member includes individual fingers moving independently with respect to one another, and the insert member is configured to be loaded into the housing to a mated position at which each of the fingers separately engage the FPC.

Optionally, the fingers of the insert member are configured to be substantially aligned with the FPC contacts such that the insert member provides an engagement force between the FPC contacts and the contacts. In one embodiment, the FPC includes a first row of FPC contacts and a second row of FPC contacts, wherein the fingers of the insert member are configured to be substantially aligned with the first and second rows of FPC contacts when the insert member is in the mated position. The electrical connector may include a supporting element coupled to the housing and being spaced apart from the contact interface, wherein the insert member engages the supporting element when the insert member is in the mated position. Optionally, the insert member may include a base, wherein the fingers are integrally formed with and extend outward from the base, and the fingers may include a spring portion being configured to flex against the supporting element when the insert is in the mated position.

In another aspect, an electrical connector is provided for communicating with a mating component having a mating surface with at least one row of mating contacts. The electrical connector includes a housing having a mating interface extending along the mating surface of the mating component. The housing is configured to receive an end of a flexible printed circuit (FPC) having at least one row of FPC contacts extending along a contact interface. The contact interface extends along the mating interface such that the contacts are configured to engage the at least one row of mating contacts. An insert member is received within the housing. The insert member includes individual fingers moving independently with respect to one another, and the insert member is configured to be loaded into the housing to a mated position at which each of the fingers separately engage the FPC.

DETAILED DESCRIPTION OF THE INVENTION

Figure 1:
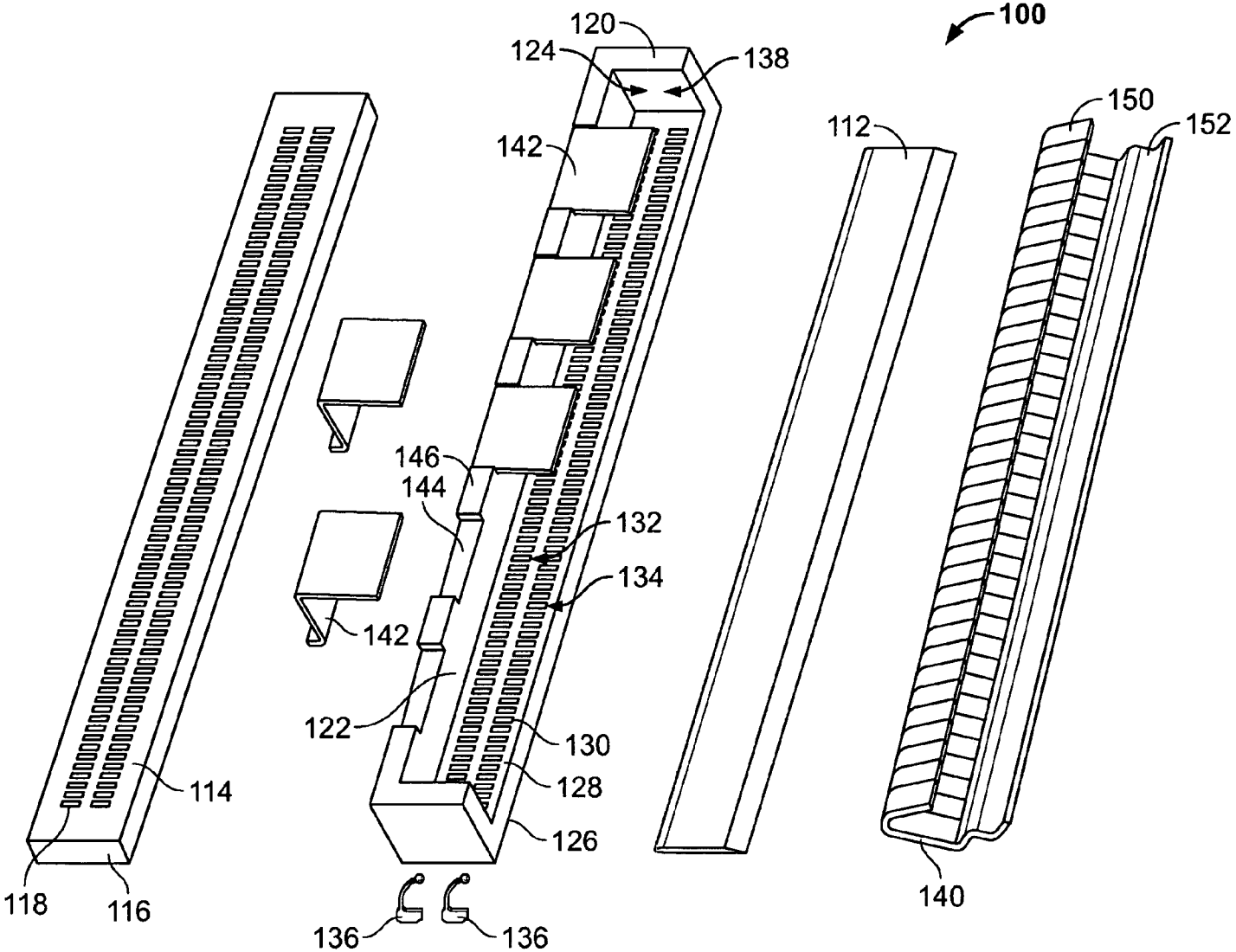
FIG. 1 is an exploded isometric view of an electrical connector formed in accordance with an exemplary embodiment of the present invention.

FIG. 1 is an exploded isometric view of an electrical connector 100 formed in accordance with an exemplary embodiment of the present invention. The electrical connector 100 utilizes a flexible printed circuit (FPC) 112, which is described further with reference to FIGS. 2 and 3. The electrical connector 100 is configured to be mated to a mating surface 114 of a mating connector 116. In one embodiment, the mating connector 116 is a circuit board having a plurality of contacts 118 on the mating surface 114. However, other types of mating connectors 116 may be used.

The electrical connector 100 includes a housing 120 having a plurality of walls 122 defining an insert chamber 124. The housing 120 is fabricated from an insulative material, such as a plastic material. Optionally, portions of the housing 120 may be fabricated from a conductive material, such as a metal material. An outer surface of one of the walls 122 defines a mating interface 126. The mating interface 126 interfaces with the mating connector 116. On an inner surface of the wall 122 defining the mating interface 126, a contact interface 128 is defined. As such, the contact interface 128 is generally opposed from the mating interface 126. A plurality of contact apertures 130 extend through the wall 122 between the contact interface 128 and the mating interface 126. The contact apertures 130 are arranged in a first row 132 and a second row 134, however more or less than two rows may be provided. Contacts 136 are received in the contact apertures 130 and extend at least between the contact interface 128 and the mating interface 126. Optionally, the contacts 136 extend beyond the surfaces defined by the contact and mating interfaces 128 and 126. In one embodiment, the contacts 136 are received in less than all of the contact apertures 130.

The housing 120 also includes an insert window or envelope 138 for receiving an insert member or stuffer 140 therein. In one embodiment, a wall 122 of the housing 120 includes an opening defining the insert window 138. Optionally, the insert window 138 may extend substantially an entire length of the housing 120. The insert window 138 may extend for a length that is substantially equal to or slightly longer than the row of contact apertures 132 or 134. In one embodiment, the insert window 138 extends substantially perpendicular from the contact interface 128 of the housing 120. The insert window 138 provides access to the insert chamber 124.

The housing 120 includes a supporting element 142 for supporting the insert member 140 when the insert member 140 is loaded into the insert chamber 124. The supporting element 142 is substantially rigid and extends substantially parallel to and spaced apart from the contact interface 128. In one embodiment, the supporting element 142 is separately provided from and coupled to the housing 120. Optionally, a plurality of supporting elements 142 are provided along the insert chamber 124 to define a boundary of the insert chamber 124. For example, the plurality of supporting elements 142 may be received within grooves or slots 144 defined in a wall 122 of the housing 120. The grooves 144 are spaced apart from one another and a ledge portion 146 of the wall 122 extends between each groove 144. In an alternative embodiment, a wall 122 of the housing 120 may define the supporting element 142, such that the insert member 140 engages the wall 122 defining the supporting element 142 of the housing 120. Optionally, the supporting elements 142 may be fabricated from a metal material. In one embodiment, the supporting elements 142 extend along a wall 122 of the housing 120. The supporting elements 142 may be secured or coupled to the wall 122 and/or mating connector 116, such as by a soldering process or an adhesion process. In one embodiment, the supporting elements 142 define a ground path for the electrical connector 100, as will be described in more detail below.

As indicated above, the insert member 140 is loaded into the insert chamber 124. Additionally, and as will be described below in more detail, the FPC 112 is also received within the insert chamber 124. For example, the FPC 112 is received within the insert chamber 124 along the contact interface 128 such that the FPC 112 engages the contacts 136. When loaded, the insert member 140 engages the supporting elements 142 and the FPC 112. In an exemplary embodiment, the insert member 140 is biased against the FPC 112 by the supporting elements 142. As such, an engagement force is transferred from the FPC 112 to the contacts 136, thus providing an electrical connection between the FPC 112 and the contacts 136. Additionally, the insert member 140 includes a plurality of individual fingers 150 extending from a base 152. The individual fingers 150 are configured to move independently with respect to one another, such that the fingers 150 separately engage the FPC 112 and provide an individual biasing force or engagement force along the FPC 112.

Figure 2:
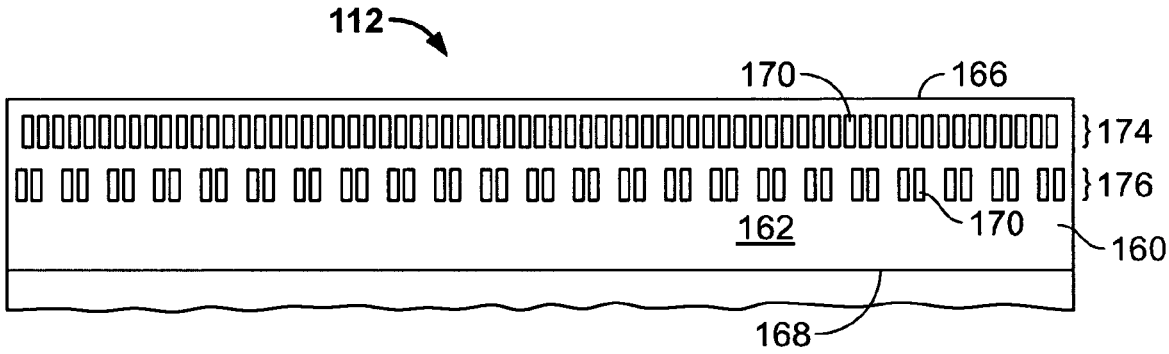
FIG. 2 is a top plan view of an exemplary flexible printed circuit for use with the electrical connector shown in FIG. 1.
Figure 3:
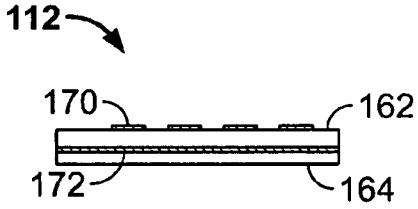
FIG. 3 is a cross-sectional view of a portion of the exemplary flexible printed circuit shown in FIG. 2.

FIG. 2 is a top plan view of an exemplary FPC 112 for use with the electrical connector 100, and FIG. 3 is a cross-sectional view of a portion of the FPC 112. The FPC 112 includes a body 160 fabricated or manufactured from a flexible, insulative material, and extending between top and bottom surfaces 162 and 164. The FPC 112 also includes a loading or front end 166 and a rear end 168. The FPC 112 includes FPC contacts 170 on the top surface 162 of the body 160. Optionally, the FPC 112 may also include FPC contacts 170 on the bottom surface 164. The FPC contacts 170 may be contact pads which are elevated from the outer surface of the body 160. Alternatively, the FPC contacts 170 may be traces routed along the outer surface. In one embodiment, the FPC includes a ground plane 172, and at least some of the FPC contacts 170 are grounded to the ground plane 172.

As illustrated in FIG. 2, the FPC contacts 170 extend along the top surface 162 in a first row 174 and a second row 176. However, the FPC 112 may include more or less than two rows of FPC contacts 170. In one embodiment, the first row 174 defines a row of signal contacts and the second row 176 defines a row of ground contacts. Alternatively, both rows may include signal contacts and or ground contacts. In one embodiment, adjacent FPC contacts 170 form a differential pair. The differential pairs may be separated by ground contacts.

Figure 4:
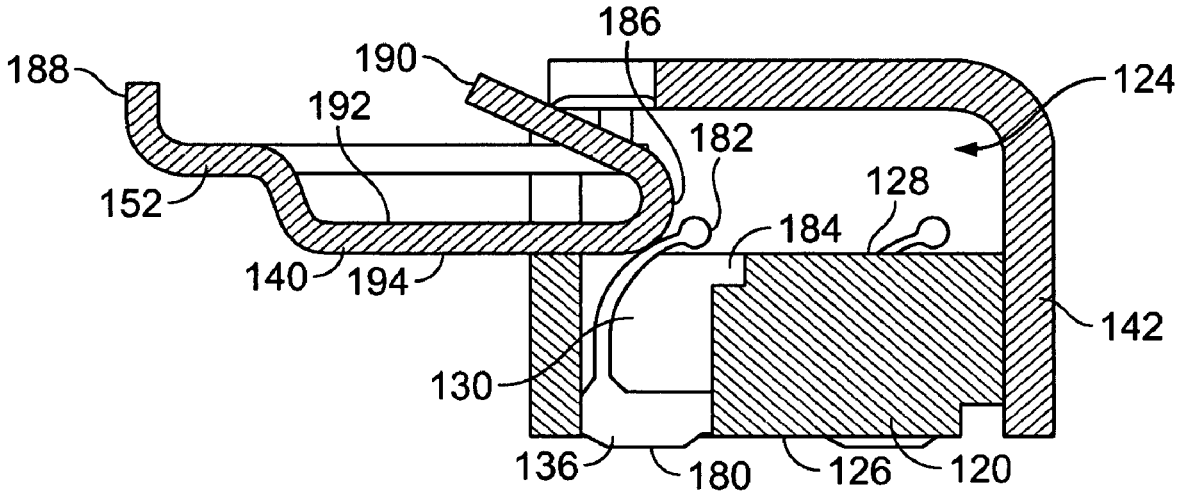
FIG. 4 is a cross-sectional view of the electrical connector shown in FIG. 1 in one state of assembly.
Figure 5:
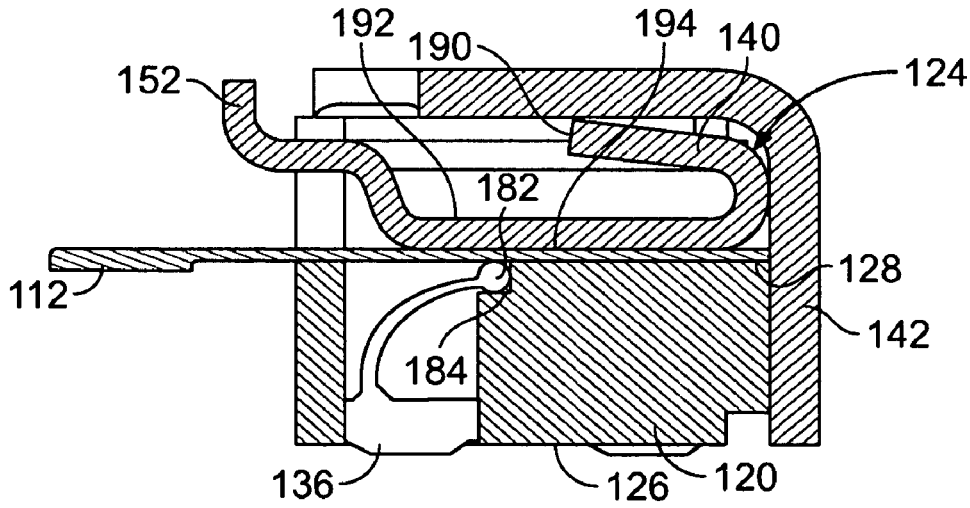
FIG. 5 is a cross-sectional view of the electrical connector shown in FIG. 1 in another state of assembly.

FIG. 4 is a cross-sectional view of the electrical connector 100 in one state of assembly. FIG. 5 is a cross-sectional view of the electrical connector 100 in another state of assembly. For example, FIG. 4 illustrates the electrical connector 100 in an unmated state and FIG. 5 illustrates the electrical connector in a mated state.

During assembly, the supporting element 142 is attached to the housing 120, such as by an adhesive, a fastener element, or the like. Optionally, the supporting element 142 may be attached to the housing 120 by an interference fit. The supporting element 142 may also be coupled to the mating connector 116 (shown in FIG. 1) for additional stability and/or to mount the housing to the mating connector 116. Once positioned, the supporting element 142 and the housing 120 define the insert chamber 124. The insert window 138 (shown in FIG. 1) opens to the insert chamber 124 and receives the insert member 140 during assembly. Additionally, the contacts 136 are loaded into the contact apertures 130 such that a mating end 180 of each contact 136 protrudes beyond or is substantially flush with the mating interface 126 of the housing 120 and an insert end 182 of each contact 136 protrudes beyond or is substantially flush with the contact interface 128 of the housing 120. In an exemplary embodiment, each contact 136 is pliant or flexible such that the contact 136 may be biased during assembly. The housing 120 includes a notched out portion 184 within each contact aperture 130 for receiving the insert end 182 of the contact 136 when assembled. In alternative embodiments, a rigid and stationary contact 136 is received within each contact aperture 130 such that an insert end 182 of the contact extends beyond or is substantially flush with the contact interface 128. Additionally, during assembly, the loading end 166 of the FPC 112 is loaded into the insert chamber 124 such that the FPC contacts 170 (shown in FIGS. 2 and 3) are substantially aligned with the contacts 136, such as illustrated in FIG. 5.

In the unmated state, as illustrated in FIG. 4, the insert member 140 is positioned outside of the insert chamber 124. A front end 186, which is generally opposed from the base 152 of the insert member 140, is aligned with the insert window 138. During mating, the front end 186 is loaded through the insert window 138 and into the insert chamber 124. In the mated state, as illustrated in FIG. 5, the insert member 140 is positioned within the insert chamber 124.

The base 152 of the insert member 140 includes a lip 188 and defines a handle for loading the insert member 140 into the insert chamber 124. The fingers 150 are integrally formed with the base 152 and are interconnected with one another by the base 152. Each finger 150 extend from the base 152 to a tip 190. The fingers 150 each have a folded over configuration such that the fingers 150 define spring members. Specifically, the tip 190, and a portion of each finger 150 extending from the tip 190, is spaced apart from a central portion 192 of the fingers 150 and may be compressed. The front end 186 of each finger 150 is positioned between the tip 190 and the central portion 192. Additionally, the central portion 192 includes an engagement surface 194 extending along the contact interface 128. When the electrical connector 100 is assembled, the engagement surface 194 engages the FPC 112. For example, the FPC 112 is positioned directly between the engagement surface 194 of the insert member 140 and the contact interface 128 of the housing 120 and/or the FPC 112 is positioned directly between the engagement surface 194 and the contact 136.

The tip 190 of the finger 150 is configured such that the tip 190 will engage the supporting element 142 during the mating process. For example, the spacing between the tip 190 and the central portion 192 is greater than the height of the insert chamber 124. Thus, when loaded into the insert chamber 124, the fingers 150 are flexed. For example, the tip 190 is compressed from a normal position and is biased against the supporting element 142. The biasing of the fingers 150 forces the engagement surface 194 against the FPC 112. Additionally, the biasing of the fingers 150 also forces the insert end 182 of each contact 136 into the notched out portion 184 of each contact aperture 130.

By providing the individual fingers 150, the FPC 112 is accurately and reliably engaged with the contacts 136 along the entire FPC 112. By selecting a finger width which is configured to engage a predetermined number of contacts 136, such as, for example, between approximately two and approximately ten contacts 136, the fingers 150 may provide a more reliable engagement between the FPC 112 and the contacts 136, as compared to a rigid insert member 140 which engages all of the contacts 136. Alternatively, the finger width may be chosen to engage more than ten contacts 136 or less than two contacts 136 depending on the particular application.

Figure 6:
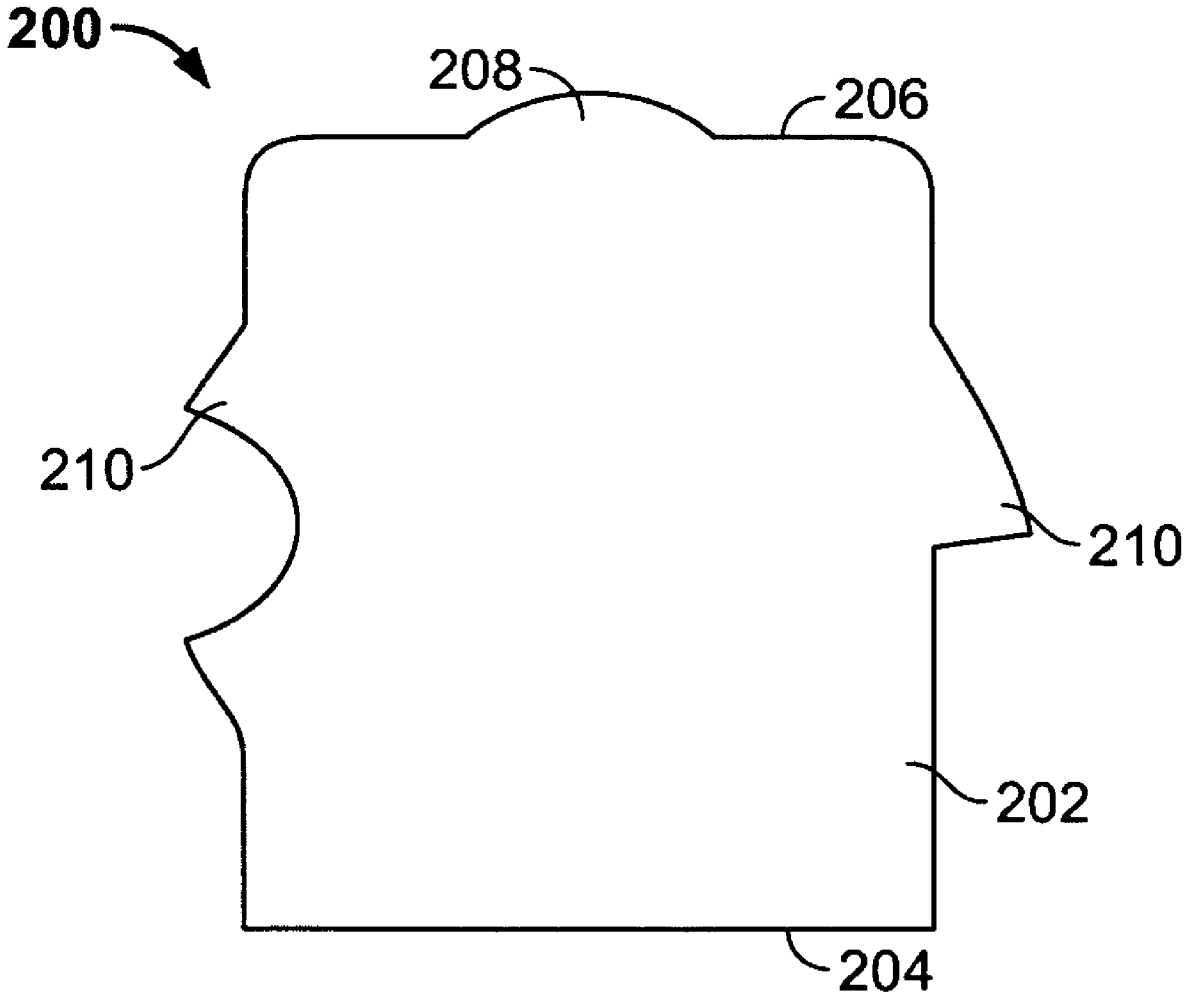
FIG. 6 is a side view of an alternative contact for use with the electrical connector shown in FIG. 1.

FIG. 6 is a side view of an alternative contact 200 for use with the electrical connector 100. The contact 200 includes a rigid body 202, as opposed to the pliant or flexible contact 136 illustrated in FIGS. 4 and 5. The contact 200 includes a mating end 204 for engaging with the mating connector 116 (shown in FIG. 1) and an insert end 206 for engaging with the FPC 112 (shown in FIGS. 1-3 and 5), and more particularly, the FPC contact 170 (shown in FIGS. 2 and 3). Optionally, the contact 200 may include a protrusion 208 to facilitate engaging the FPC 112. In one embodiment, the contact includes barbs 210 extending from the body 202 for engaging with the housing 120 (shown in FIGS. 1, and 4-5), and more particularly, the contact apertures 130 (shown in FIGS. 1, and 4-5).

Figure 7:
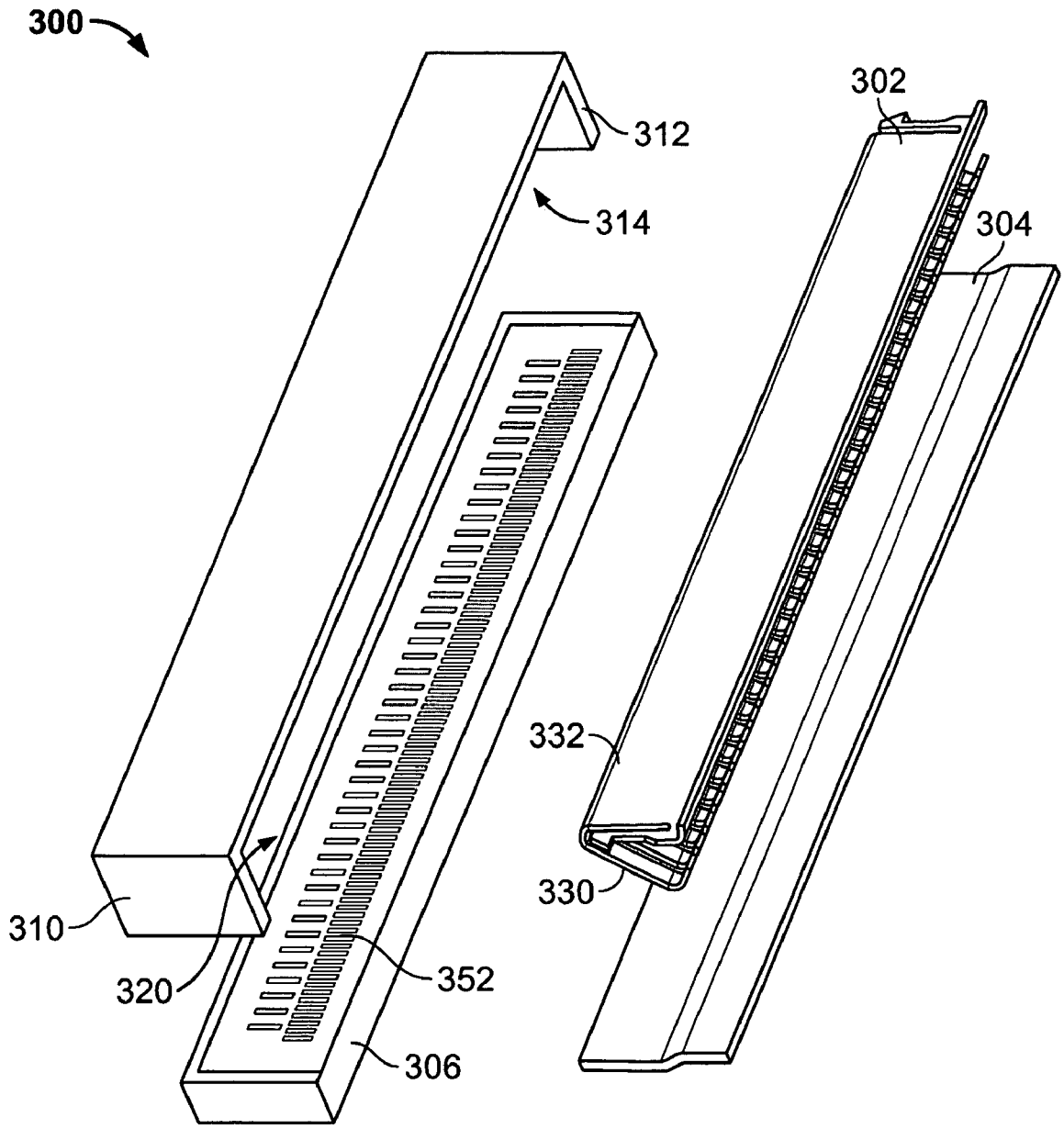
FIG. 7 is an exploded isometric view of an electrical connector formed in accordance with an alternative embodiment of the present invention.
Figure 8:
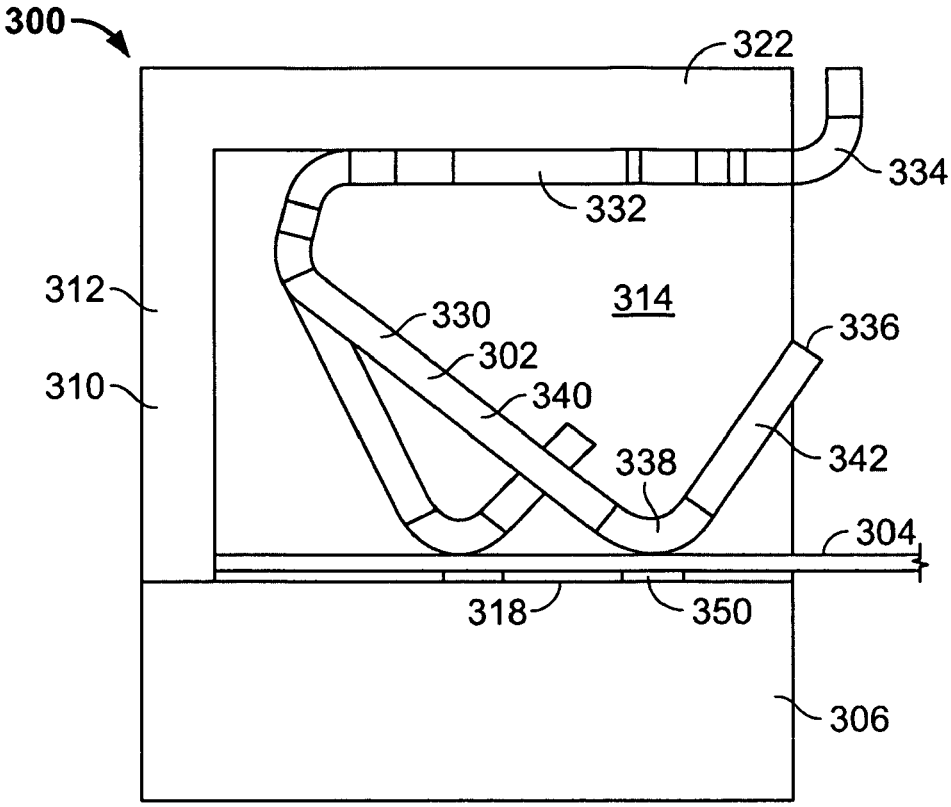
FIG. 8 is a cross-sectional view of the alternative electrical connector shown in FIG. 7.
Figure 9:
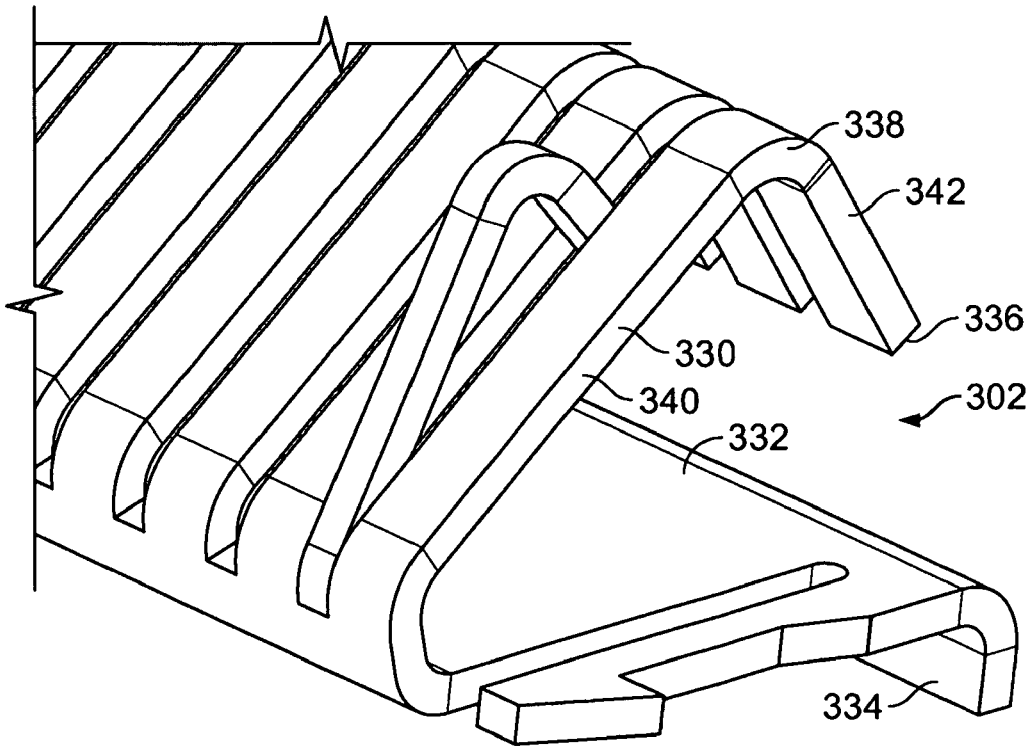
FIG. 9 is an isometric view of an insert member for use with the alternative electrical connector shown in FIG. 7.

FIG. 7 is an exploded isometric view of an electrical connector 300 formed in accordance with an alternative embodiment of the present invention. FIG. 8 is a cross-sectional view of the alternative electrical connector 300. FIG. 9 is an isometric view of an insert member 302 for use with the alternative electrical connector 300. The electrical connector 300 is similar to the electrical connector 100 (shown in FIG. 1), however, electrical connector 300 may be used to directly couple or connect an FPC 304 to a mating connector 306. As such, the electrical connector 300 does not include individual contacts, such as the contacts 136 (shown in FIGS. 1, and 4-5) included within the electrical connector 100. Rather, the FPC 304 is directly coupled to the mating connector 306. By eliminating the contacts, the connection between the FPC 304 and the mating connector 306 may be improved.

The electrical connector 300 includes a housing 310 having a plurality of walls 312 defining an insert chamber 314. One of the walls 312 includes a mating interface 318 configured to interface with the mating connector 306. As such, the housing 310 is open to the mating connector 306 along the mating interface 318. Optionally, the mating interface 318 may extend substantially the entire length of the housing 310. The housing 310 also includes an insert window or envelope 320 for receiving the insert member 302 therein. In one embodiment, the insert window 320 extends substantially perpendicular from the mating interface 318 of the housing 310. The insert window 320 provides access to the insert chamber 314. The housing 310 includes a supporting element 322 for supporting the insert member 302 when the insert member 302 is loaded into the insert chamber 314. The supporting element 322 is substantially rigid and extends substantially parallel to and spaced apart from the mating interface 318. In an exemplary embodiment, a wall 312 of the housing 310 defines the supporting element 322.

As best illustrated in FIG. 9, the insert member 302 includes a plurality of individual fingers 330 extending from a base 332. The individual fingers 330 are configured to move independently with respect to one another, such that the fingers 330 separately engage the FPC 304 when assembled and provide an individual biasing force or engagement force along the FPC 304. The base 332 includes a lip 334 and defines a handle for loading the insert member 302 into the insert chamber 314. The fingers 330 are integrally formed with the base 332 and are interconnected with one another by the base 332. Each finger 330 extends from the base 332 to a tip 336, and includes an engagement portion 338 along the finger 330 between the base 332 and the tip 336. For example, each finger 330 has a central portion 340 extending between the base 332 and the engagement portion 338. Additionally, each finger 330 has a tip portion 342 extending between the engagement portion 338 and the tip 336. In one embodiment, each engagement portion 338 is substantially aligned in a row along the insert member 302. Optionally, and as illustrated in FIG. 9, the fingers 330 of the insert member 302 define two rows such that the engagement portions 338 of at least some of the fingers 330 are aligned in a first row and the remaining engagement portions 338 are aligned in a second row. In other embodiments, the fingers 330 may define more than two rows of engagement portions 338. For example, the number of rows may relate to the number of rows of FPC contacts on the FPC 304.

As illustrated in FIG. 8, when the electrical connector 300 is assembled, the housing 310 is coupled to the mating connector 306. The FPC 304 is loaded into the housing 310 and extends along the mating interface 318. FPC contacts 350 are aligned with and engage mating contacts 352 (shown in FIG. 7) of the mating connector 306. The insert member 302 is loaded into the insert chamber 314 and engages the supporting element 322 and the FPC 304. In a similar manner as the insert member 140 (shown in FIG. 4 and 5), the insert member 302 is flexed during loading. For example, the spacing between the engagement portions 338 and the base 332 is greater than the height of the chamber 314 such that fingers 330 are deflected during loading. The biasing of the fingers 330 forces the engagement portions 338 against the FPC 304. For example, the FPC 304 is positioned directly between the engagement portions 338 and the mating connector 306 and/or the mating contacts 352. By providing the individual fingers 330, the FPC contacts 350 of the FPC 304 are accurately and reliably engaged with the mating contacts 352 along the entire FPC 304, as compared to a rigid insert member which engages the entire FPC 304 with a single engagement surface.

Figure 10:
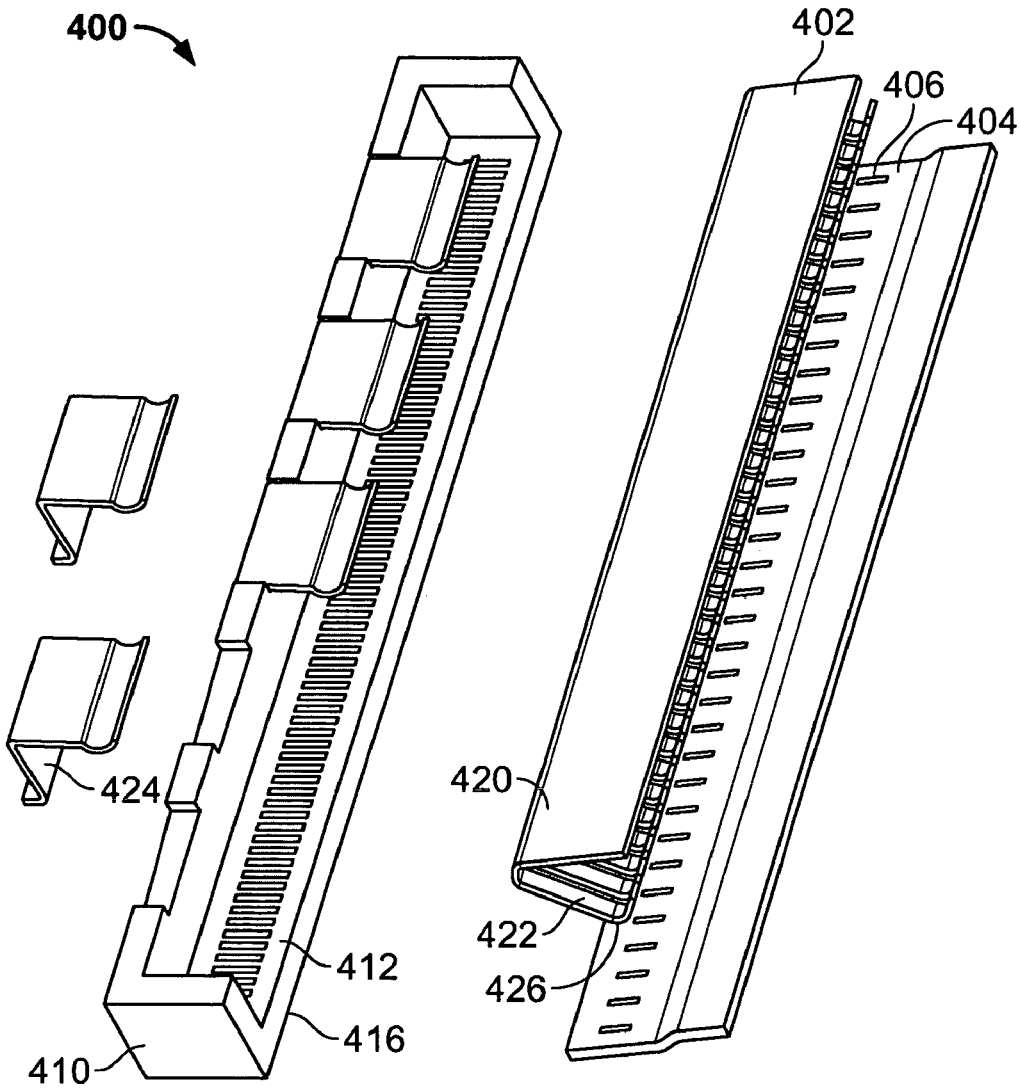
FIG. 10 is an exploded isometric view of another alternative electrical connector.
Figure 11:
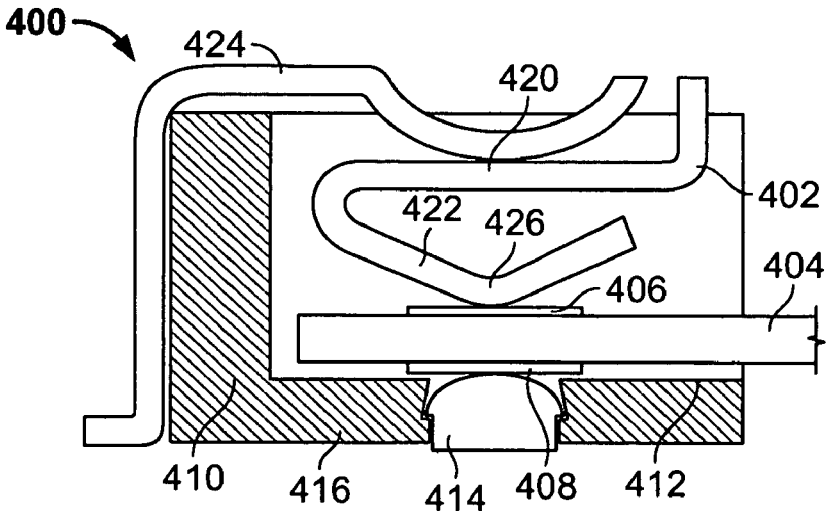
FIG. 11 is a cross-sectional view of the alternative electrical connector shown in FIG. 10.

FIG. 10 is an exploded isometric view of another alternative electrical connector 400. FIG. 11 is a cross-sectional view of the alternative electrical connector 400. The electrical connector 400 is similar to the electrical connector 100 (shown in FIG. 1), however, the electrical connector 400 may be used to provide a ground path through an insert member 402.

As best illustrated in FIG. 11, the electrical connector 400 utilizes a FPC 404 having a first or upper row of FPC contacts 406 and a second or lower row of FPC contacts 408. The first and second rows of FPC contacts 406 and 408 are positioned on opposing surfaces of the FPC 404. When assembled, the FPC 404 is loaded into a housing 410 along a contact interface 412. Contacts 414 are received within the housing 410 and extend between the contact interface 412 and a mating interface 416 of the housing 410. Alternatively, the electrical connector 400 may utilize a direct attach type of FPC wherein the FPC is directly attached to a mating connector (not shown). When assembled, the second row of FPC contacts 408 engage the contacts 414 along the contact interface 412. Optionally, more than one row of contacts 414 may be provided within the housing, and correspondingly, the FPC 404 would also include more than one row of FPC contact 408.

When assembled, the insert member 402, including a base 420 and a plurality of fingers 422, is loaded into the housing 410. The insert member 402 engages and is biased against a supporting element 424. Additionally, an engagement portion 426 of each finger 422 engages and is biased against the FPC 404, and more particularly, the first row of FPC contacts 406. In an exemplary embodiment, the insert member 402 and the supporting element 424 are fabricated from a conductive material, such as a metal material. In use, a ground path is created between the first row of FPC contacts 406, the insert member 402 and the securing element 424.

Figure 13:
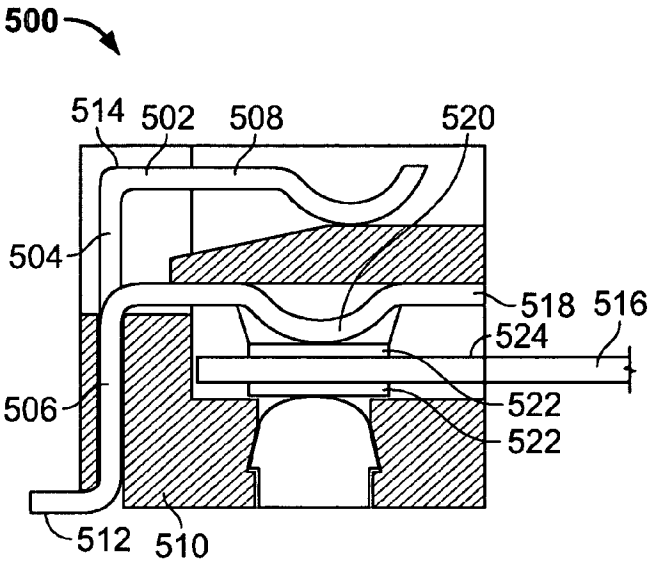
FIG. 13 is a cross-sectional view of the alternative electrical connector shown in FIG. 12.
Figure 12:
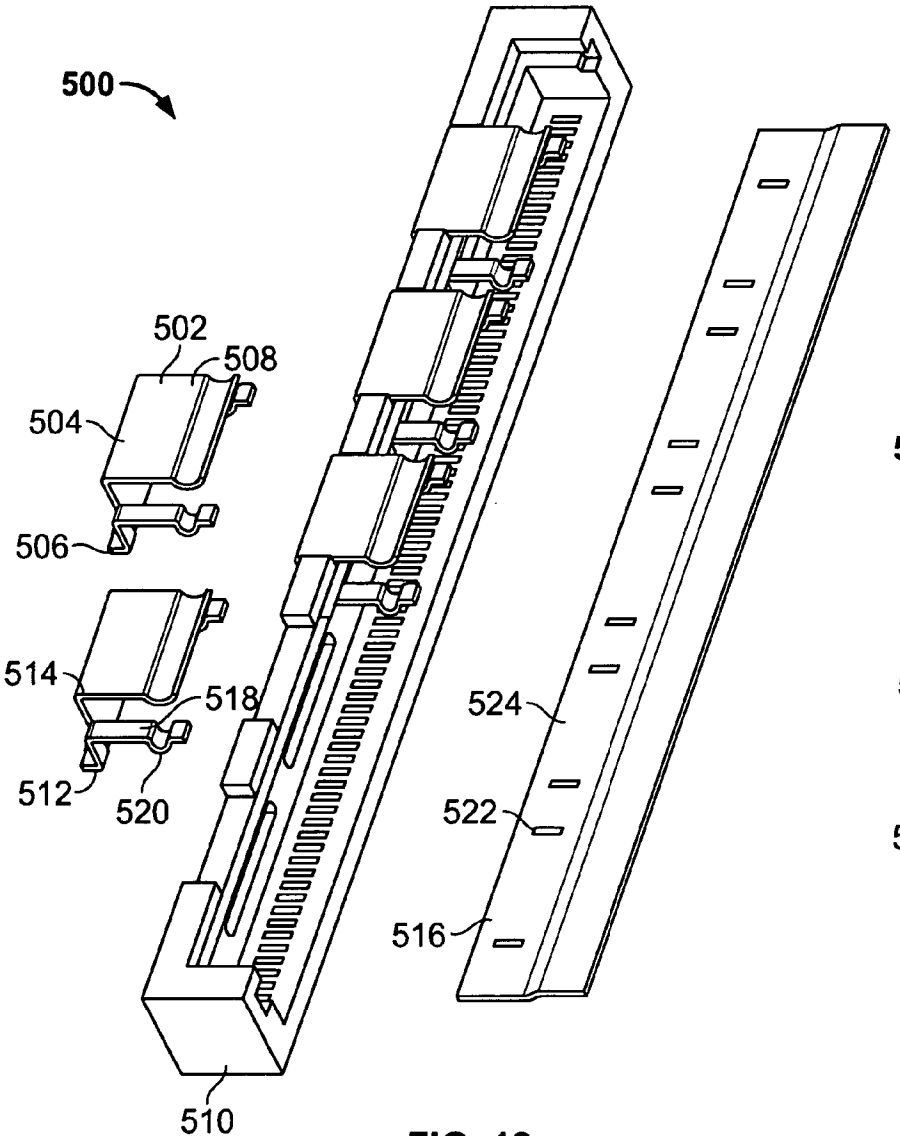
FIG. 12 is an exploded isometric view of a further alternative electrical connector.

FIG. 12 is an exploded isometric view of a further alternative electrical connector 500. FIG. 13 is a cross-sectional view of the alternative electrical connector 500. The electrical connector 500 is similar to the electrical connector 400 (shown in FIGS. 10 and 11), however, electrical connector 500 includes alternative supporting elements 502 for creating the grounding path.

Each supporting element 502 includes a body 504 having a base section 506 and a supporting section 508. The base section 506 is configured to attach to a housing 510 and/or a mating connector (not shown). The base section 506 extends between a bottom 512 and top 514. The bottom 512 may be coupled to the mating connector, such as by a soldering process. The supporting section 508 is configured to provide a biasing force to an insert member (not shown) such that the insert member engages a FPC 516. The supporting section 508 extends generally perpendicularly from the top 514 of the base section 506.

The supporting element 502 also includes grounding tabs or arms 518 extending outward from the base section 506. The grounding tabs 518 extend substantially parallel to the supporting section 508. The grounding tabs 518 are spaced apart from the supporting section 508 such that an engagement portion 520 of the grounding tabs 518 engage the FPC 516. Optionally, the insert member may also provide a biasing force against the grounding tabs 518 such that the grounding tabs 518 are biased against the FPC 516. In an exemplary embodiment, the FPC includes FPC contacts 522 along an upper surface 524 of the FPC 516. The grounding tabs 518 are oriented to engage the FPC contacts 522 and are biased against the FPC contacts 522. The supporting element 502 is fabricated from a conductive material, such as metal, such that a ground path is defined from the FPC contacts 522 through the supporting element 502.

Exemplary embodiments of electrical connectors are described above in detail. The electrical connectors are not limited to the specific embodiments described herein, but rather, components of each electrical connector may be utilized independently and separately from other components described herein. For example, electrical connector components in one embodiment can also be used in combination with electrical connector component in other embodiments.

While the invention has been described in terms of various specific embodiments, those skilled in the art will recognize that the invention can be practiced with modification within the spirit and scope of the claims.

What is claimed is:

1. An electrical connector comprising:

a housing having a mating interface configured to mate with a circuit board, the mating interface having a perimeter defined by a footprint of said housing, and said housing having a contact interface oriented substantially parallel to the mating interface, the contact interface being configured to receive an end of a flexible printed circuit (FPC) having at least one row of FPC contacts;

contacts received in the housing and extending between the mating interface and the contact interface, each of said contacts being configured to engage at least one of the FPC contacts at the contact interface and each of said contacts being exposed at the mating interface to engage mating contacts on the circuit board; and an insert member received within said housing, said insert member comprising a base and multiple fingers interconnected with one another by said base, said fingers being movable independently with respect to one another, said insert member configured to be loaded into said housing to a mated position at which each of said fingers separately engage the FPC.

2. The electrical connector of claim 1, wherein said fingers of said insert member are configured to be substantially aligned with the FPC contacts, and wherein said insert member engages said housing to bias each of said fingers against the FPC to provide an engagement force between the FPC contacts and said contacts.

3. The electrical connector of claim 1, wherein said fingers include a hinge portion, wherein said fingers are flexed about the hinge portion when said insert member is loaded to said mated position to force the FPC against the contacts.

4. The electrical connector of claim 1, wherein said insert member is non-planar, wherein at least a portion of said fingers extend non-orthogonally with respect to said base.

5. The electrical connector of claim 1, wherein the FPC includes a first row of FPC contacts and a second row of FPC contacts, wherein said fingers of said insert member are configured to be substantially aligned with the first and second rows of FPC contacts when said insert member is in the mated position.

6. The electrical connector of claim 5, wherein said fingers include an engagement surface configured to engage a portion of the FPC opposed to both of the first and second rows of FPC contacts.

7. The electrical connector of claim 5, wherein the first row of FPC contacts is positioned along a first side of the FPC, said contacts are configured to engage said first row of FPC contacts, and wherein the second row of FPC contacts is positioned along an opposing side of the FPC, said insert member is configured to engage said second row of FPC contacts.

8. The electrical connector of claim 1, further comprising a supporting element coupled to said housing and being spaced apart from said contact interface, said insert member being biased against said supporting element when said insert member is in the mated position.

9. The electrical connector of claim 8, wherein said insert member and said supporting element are fabricated from a conductive material, said fingers are configured to engage the FPC contacts such that said insert member defines a ground path between the FPC and said supporting element.

10. The electrical connector of claim 8, wherein said fingers are integrally formed with and extend outward from said base, said fingers comprising a spring portion being configured to flex against said supporting element when said insert member is in the mated position.

11. An electrical connector for communicating with a circuit board having a mating surface with at least one row of mating contacts, said electrical connector comprising:

a housing having a mating interface extending along the mating surface of the circuit board, said housing configured to receive an end of a flexible printed circuit (FPC) having at least one row of FPC contacts extending along a contact interface, the contact interface of the FPC extending along, and being coincident with, the mating interface of the housing such that the FPC contacts are configured to directly engage the at least one row of mating contacts; and an insert member received within said housing, said insert member comprising a base and multiple fingers interconnected with one another by said base, said fingers being movable independently with respect to one another, said insert member configured to be loaded into said housing to a mated position at which each of said fingers separately engage the FPC.

12. The electrical connector of claim 11, wherein said fingers of said insert member are substantially aligned with the FPC contacts such that said insert member provides an engagement force between the FPC contacts and the mating contacts.

13. The electrical connector of claim 11, wherein said housing comprises a supporting element being spaced apart from said mating interface, said insert member being biased against said supporting element when said insert member is in the mated position.

14. The electrical connector of claim 11, wherein said insert member is non-planar, wherein at least a portion of said fingers extend non-orthogonally with respect to said base.

15. The electrical connector of claim 11, wherein the FPC includes a first row of FPC contacts and a second row of FPC contacts, wherein said fingers of said insert member are configured to be substantially aligned with the first and second rows of FPC contacts when said insert member is in the mated position.

16. The electrical connector of claim 15, wherein said fingers include an engagement surface configured to engage a portion of the FPC opposed to both of the first and second rows of FPC contacts.

17. The electrical connector of claim 15, wherein the first row of FPC contacts is positioned along a first side of the FPC, said mating contacts are configured to engage said first row of FPC contacts, and wherein the second row of FPC contacts is positioned along an opposing side of the FPC, said insert member is configured to engage said second row of FPC contacts.

18. The electrical connector of claim 11, wherein said fingers include a hinge portion, wherein said fingers are flexed about the hinge portion when said insert member is loaded to said mated position to force the FPC against the contacts.

19. The electrical connector of claim 18, wherein said insert member and said supporting element are fabricated from a conductive material, said fingers are configured to engage the FPC contacts such that said insert member defines a ground path between the FPC and said supporting element.

20. The electrical connector of claim 18, wherein said fingers are integrally formed with and extend outward from said base, said fingers comprising a spring portion being configured to flex against said supporting element when said insert member is in the mated position.

* * * * *